US006386754B2

(12) United States Patent
Terzian

(10) Patent No.: US 6,386,754 B2
(45) Date of Patent: May 14, 2002

(54) CROWN CONTROL FOR ENHANCED QUADRIBALANCED DIGITAL TIME DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 09/865,396

(22) Filed: May 25, 2001

Related U.S. Application Data

(63) Continuation of application No. 09/679,864, filed on Oct. 5, 2000, which is a continuation-in-part of application No. 09/619,368, filed on Jul. 19, 2000, now Pat. No. 6,215,736, which is a continuation-in-part of application No. 09/482,479, filed on Jan. 12, 2000, now abandoned.

(51) Int. Cl.[7] ..... G04C 19/00
(52) U.S. Cl. ..... 368/187; 368/239; 368/882
(58) Field of Search ..... 368/107–113, 82–84, 368/239–242, 223, 187–192

(56) References Cited

U.S. PATENT DOCUMENTS 4,600,316 A 7/1986 Besson ..... 368/187

*Primary Examiner*—Bernard Roskoski
(74) *Attorney, Agent, or Firm*—Lucas & Just

(57) ABSTRACT

Quadribalanced digital time displays and methods comprising increasing digital minutes displayed on the right flank of centrally positioned digital present hours, in relatively upper and lower positions during the first and second quarter hours, followed by decreasing digital minutes displayed on the left flank of digital next hours, in relatively lower and upper positions during the third and fourth quarter hours, are enhanced by simultaneously displaying markers in one or more of the three quarter hour minute positions not containing digital minutes at any one time to inform the viewer that such marked positions are functional elements of the display but not activated due to the current time being displayed in another of said minute positions at that time. A single displaceable crown control is also provided for facilitating the operation of a timepiece embodying such enhanced quadribalanced time displays and methods.

4 Claims, 12 Drawing Sheets

CROWN CONTROL FOR ENHANCED QUADRIBALANCED DIGITAL TIME DISPLAYS

CROSS-REFERENCE TO RELATED APPLICATION

This application is a continuation of co-pending application Ser. No. 09/679,864 filed Oct. 5, 2000, which is a continuation-in-part of application Ser. No. 09/619,368 filed Jul. 19, 2000, now U.S. Pat. No. 6,215,736, which is a continuation-in-part of application Ser. No. 09/482,479 filed Jan. 12, 2000, now abandoned.

BACKGROUND OF THE INVENTION

I. Field of the Invention

This invention relates to timekeeping and, more particularly, to the use of digital time displays for general purpose timekeeping, as most individuals typically undertake in going about their daily activities while watching and keeping track of the time.

II. Description of the Prior Art

Quadribalanced digital time displays are described in U.S. Pat. No. 4,271,497, the disclosure of which is incorporated herein by reference. Those displays comprise centrally positioned current hour digits flanked on the right by increasing minute digits which are displayed in upper and lower positions relative to the hour digits during the first and second quarter hours. Thereafter, incremented next hour digits are flanked on the left by decreasing minute digits which are displayed in lower and upper positions relative to the hour digits during the third and fourth quarter hours. In this way the four quarter hours are precisely defined, balanced and visually differentiated, while elapsed and future time are viewed during the respective first and second halves of each hour.

III. Recognition of Problems in the Prior Art

It has now been discovered that the previous quadribalanced displays have certain characteristics which are not the most desirable. In particular, as the respective quarter hours are displayed from the first through the fourth, the corresponding minute displays occupy only a limited portion of the total space surrounding the centrally positioned hours. Throughout the hour, most of this space remains completely empty, thus giving some viewers a sense of incompleteness and a contradictory or incorrect suggestion that these spaces are not functional in the overall display, at least while they remain blank.

By way of contrast and example, most conventional dial watches and clocks are not characterized in the same way. They usually have from four to twelve hour digits, with or without intermediate minute hash marks, positioned around the periphery of the dial, thereby making the viewer visually conscious of the fact that the entire area swept around the dial by the hour and minute hands has a role in defining the time at one time or another during the course of an hour. The lack of similar symbolism and effects in the quadribalanced displays of U.S. Pat. No. 4,271,497 potentially detracts from their utility and appeal to consumers.

SUMMARY OF THE INVENTION

The present invention significantly improves the conventional quadribalanced displays discussed above. In the enhanced quadribalanced displays of the present invention, one or more of the quarter hour positions not occupied by digital minutes at any one time is/are provided with markers which serve to inform the viewer that such positions are functional parts of the overall display but not activated because the current time is defined by digital minutes being displayed in another part of the display. In this way, the emptiness of most of the space around the centrally positioned digital hours is eliminated. Instead, preferably, all four of the respective quarter hour minute positions are controlled to contain active digital displays comprising digital minutes in each of the respective first to fourth quarters and, for purposes of both differentiation and completeness, markers in the respective other three quarter hour positions which remind the viewer that those spaces are functional although not then involved in defining the current time. The enhancement of the previously described quadribalanced displays in this manner provides considerable improvement in the appeal and utility of such systems for general purpose timekeeping. Further, a single displaceable crown control is provided for facilitating the operation of timepieces embodying such enhanced displays.

Other features and details of the invention will be evident from the subsequent specific description, taken in connection with the drawings.

DESCRIPTION OF THE PREFERRED EMBODIMENT

Figure 1:
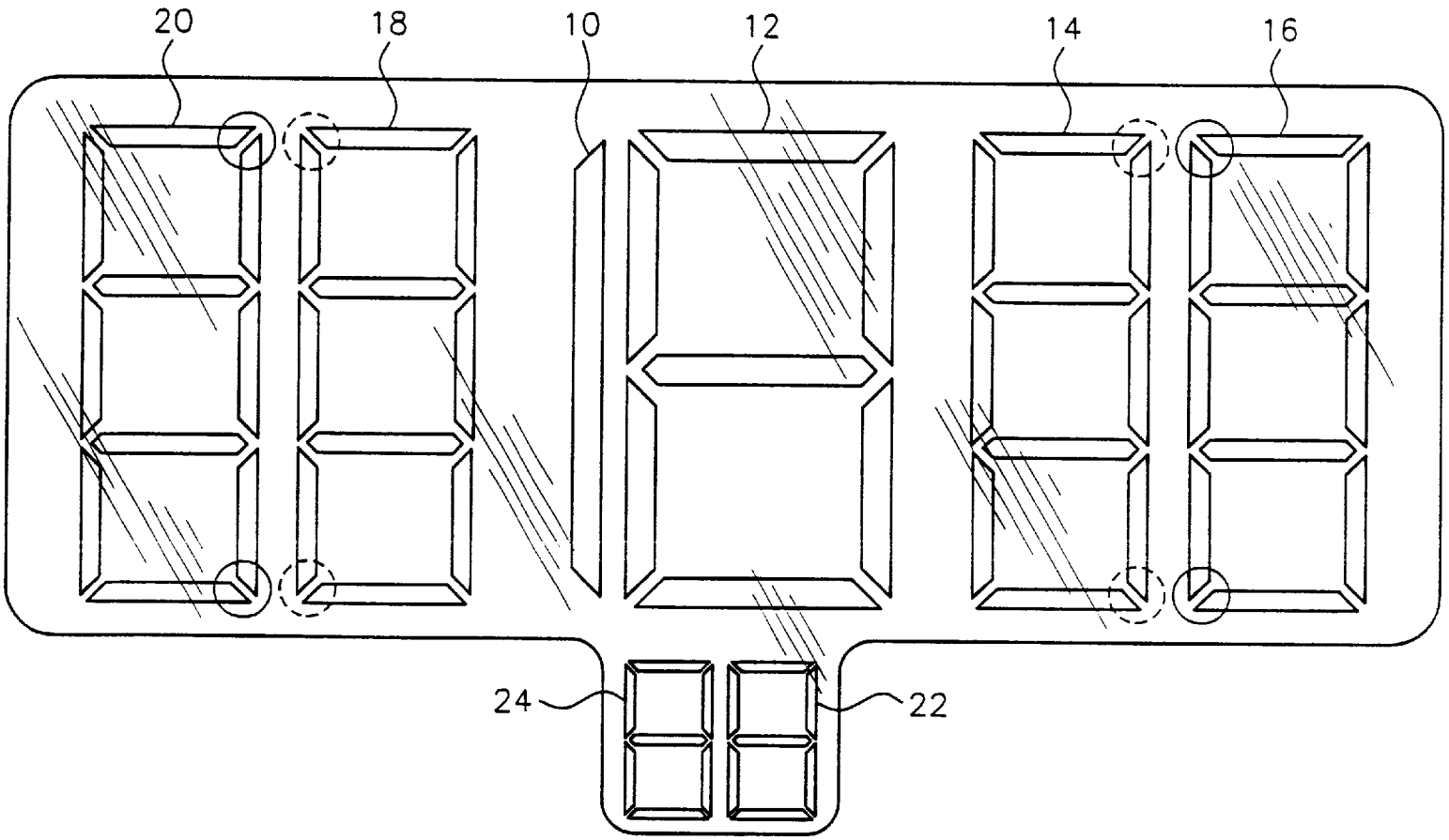
FIG. 1 (Prior Art)
FIG. 1 is a copy of FIG. 1 of U.S. Pat. No. 4,271,497 with added solid and dashed line circles around certain inboard corners of the digital minute elements (relative to the center of the display).

Referring now to FIG. 1, digital display elements 10, 12 are at the center of the display and activatable to show hours of values one to twelve, as previously explained in U.S. Pat. No. 4,271,497.

Flanking the hour elements 10, 12 on the right is a pair of 10-segmented digital display elements 14, 16 which are activatable to show increasing minutes of values zero to 30 during the first half hour, in relatively upper and lower positions generated by activating the uppermost 7 of the 10 segments during the first quarter hour and the lowermost 7 of the 10 segments during the second quarter hour, while the hour elements 10, 12 are displaying the current hour. Similarly, a second pair of 10-segmented digital display elements 18, 20 flanks the hour display elements 10, 12 on the left. This pair is activatable to show decreasing minutes of values 29 to zero during the second half hour, in relatively lower and upper positions generated by activating the lowermost 7 of the 10 segments during the third quarter hour and the uppermost 7 of the 10 segments during the fourth quarter hour, while the hour elements 10, 12 are displaying the next hour.

Finally, digital display elements 22, 24 are located below the centrally positioned hour elements 10, 12 and are activatable to show incrementing digital seconds of values 0 to 59 during each minute of the first half hour and decrementing digital seconds of values 59 to 0 during each minute of the second half hour.

The foregoing is a summary of the disclosure of U.S. Pat. No. 4,271,497, further details of which can be understood by reference to the patent document.

Referring again to the digital display elements 16 and 20 of FIG. 1, it will be seen that the uppermost and lowermost inboard corners thereof are enclosed within solid line circles. The reason for this will be understood by reference to FIG. 2 in which the same corners are shown on a magnified scale.

As illustrated, each corner includes the terminal ends of the two uppermost/lowermost horizontal and vertical elements most closely adjacent to each other on opposite sides of a very small 45° slanted gap analogous to a mitered joint. The same structure is shown in the analogous corners of the display elements 30*b* and 32*a* of FIG. 1 of U.S. Pat. No. 4,271,497. However, in FIG. 1 of this application, each of the above-referenced adjacent ends of the circled horizontal and vertical corner elements are severed and separated a second time from the remainder of the element, at the same 45° angle, to provide a pair of much smaller segments 26, 28 that can be separately activated to serve as markers, in accordance with the present invention.

Figure 3:
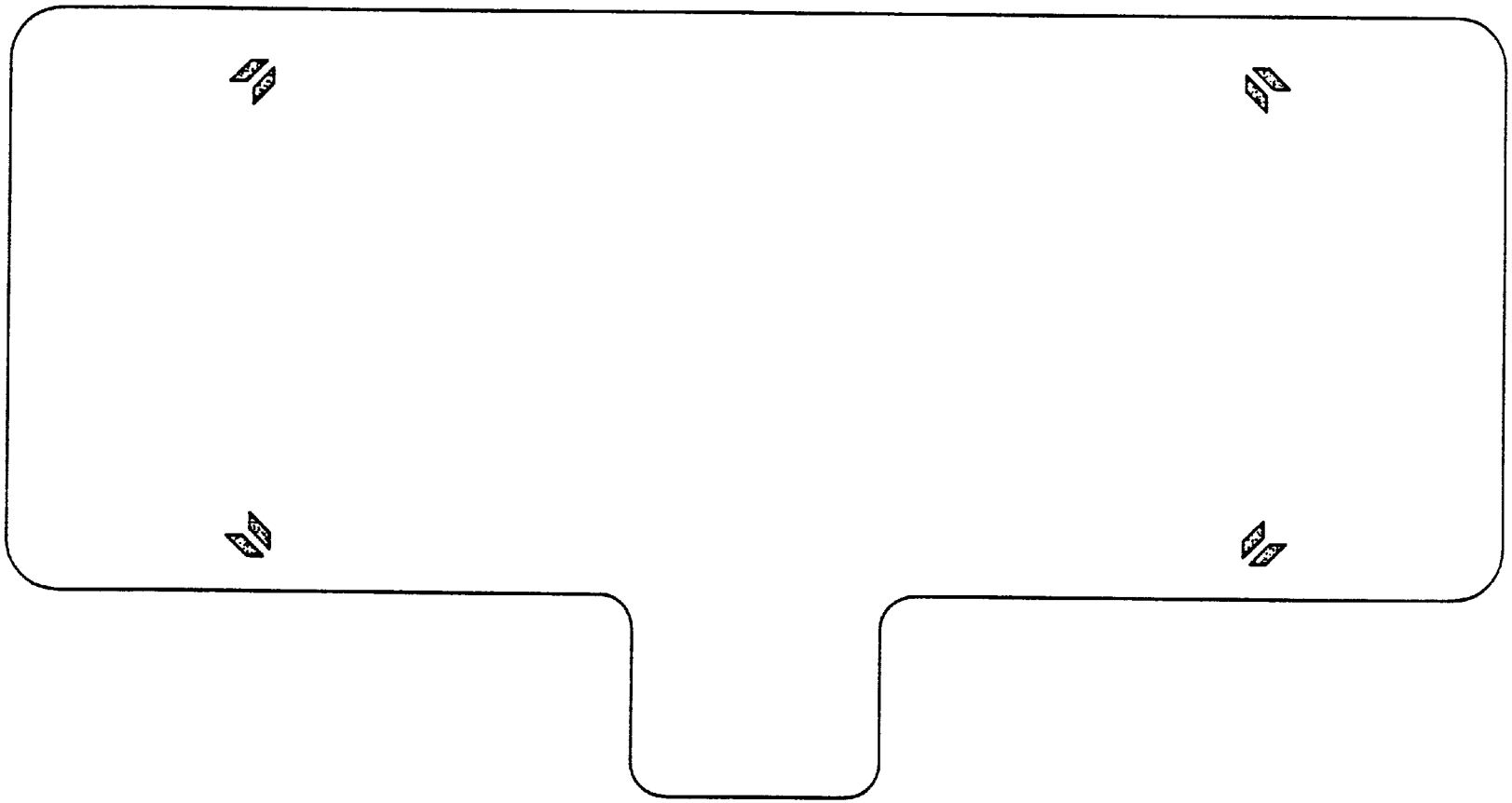
FIG. 3 is a view of the same circled corners reduced back to the scale of FIG. 1 and simultaneously activated to show the resulting markers that are used in accordance with an embodiment of the invention.

Such separate activation of all four pairs is portrayed in FIG. 3. As there seen, the severed display segments in the four corners form inclined double dashes, preferably at substantially 45° angles, and thus oriented in positions which tend to surround the central area occupied by the digital hour elements 10, 12. As a result, the viewer is given a sense of rotational motion by these markers, analogous to the sweep of the minute hand of a conventional dial watch, instead of the emptiness manifested in the display of the previously cited patent.

Figure 4:
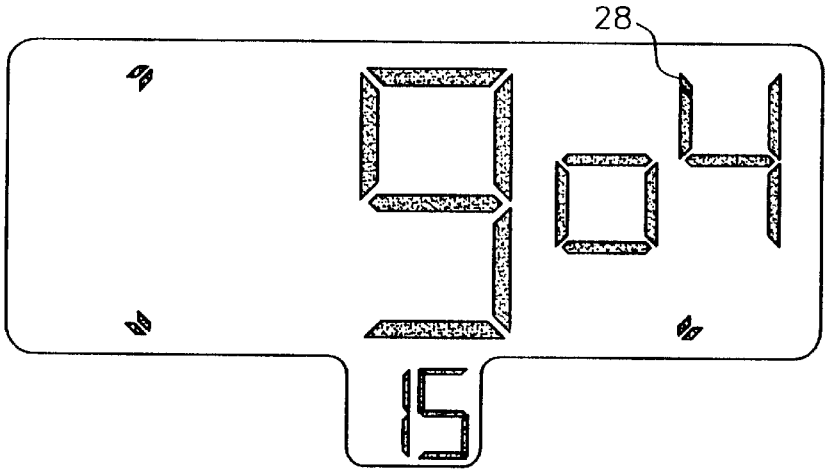
FIGS. 4–7 are views of representative time displays that are presented to the viewer during the four quarter hours in accordance with the embodiment of FIG. 3.

The resulting overall effects of differentiation and completeness are shown by the representative quarter hour time displays of FIGS. 4 through 7. In FIG. 4 the current time is four minutes and 15 seconds past nine during the first quarter hour, produced by selective activation of the corresponding elements of the hour, minute and seconds display elements in FIG. 1. In addition, the remaining three lowermost and uppermost inboard corner segments of the digital minute elements 16 and 20 have been simultaneously activated to form the three sets of inclined double dash markers at the tops and bottom of the spaces where the forthcoming current minutes of time will be displayed during the second through fourth quarters of the same hour.

It should be understood that the small marker segments 26, 28 will also be activated whenever necessary to display the full length of their particular elements as part of the digital minute value being displayed. Thus, in FIG. 4, vertical marker segment 28 is activated to provide the full length of the corresponding inboard vertical leg of the digital minute value 4.

Figure 5:
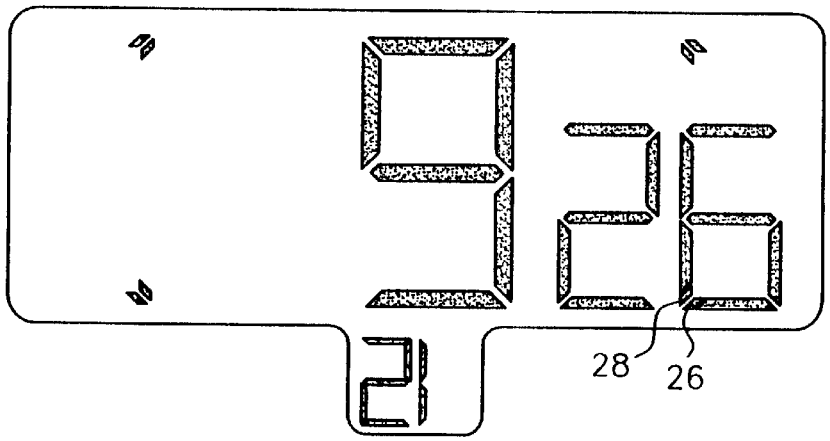

FIG. 5 displays a representative second quarter hour current time of twenty six minutes and twenty one seconds past the ninth hour, with the inclined double dash marks preferably simultaneously activated in the remaining three spaces where current minutes are normally shown during the first, third and fourth quarter hours. Both inboard marker segments 26, 28 are also activated to provide the full lengths of the corresponding lowermost horizontal and vertical legs of the digital minute value 6.

Figure 6:
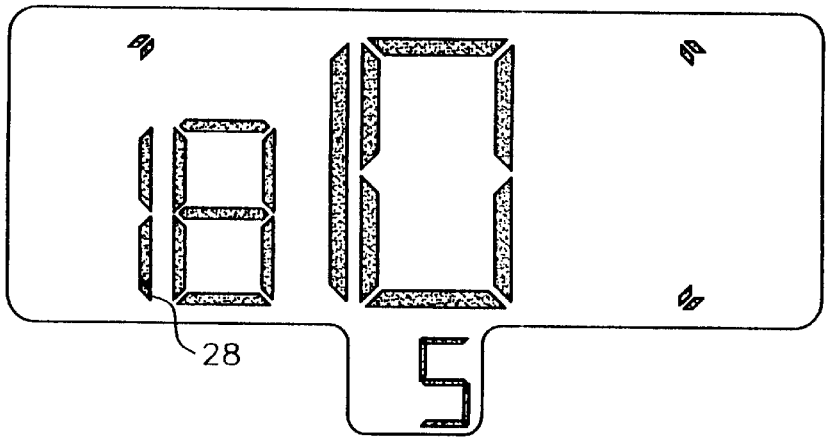

FIG. 6 displays a representative third quarter hour current time of eighteen minutes and five seconds before the tenth hour. Simultaneously, inclined double dash markers are preferably activated in the spaces where current minutes are normally shown during the first, second and fourth quarter hours. As in FIG. 4, the inboard vertical marker segment 28 is also simultaneously activated to provide the full length of the corresponding lowermost vertical leg of the digital minute value 1 in the tens of minutes position.

Figure 7:
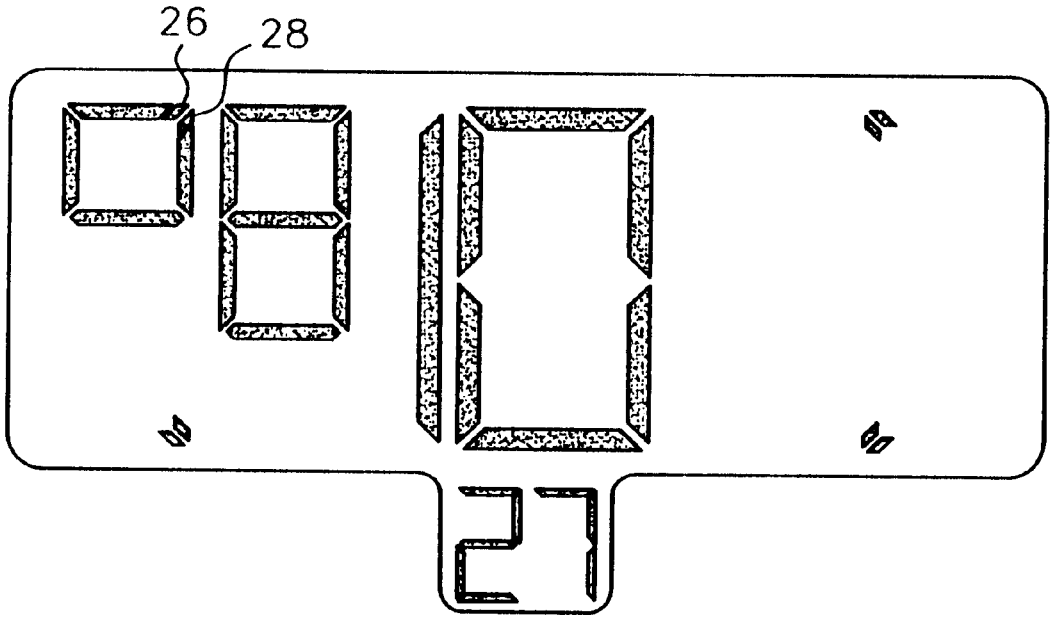

FIG. 7 completes the cycle by displaying a representative fourth quarter time of eight minutes and twenty seven seconds before the tenth hour. Simultaneously-activated inclined double dash markers preferably appear in the spaces where current minutes were earlier normally displayed during the previous three quarter hours. Also, both inboard marker segments 26, 28 are simultaneously activated to provide the full lengths of the corresponding horizontal and vertical legs of the digital minute value 0 in the tens of minutes position. Thus, by contributing differentiation and completeness of active and inactive quarter hour areas of the overall display, the newly marked displays exemplified in FIGS. 4–7 demonstrate the enhancement achieved by the present invention compared to the previous quadribalanced displays of U.S. Pat. No. 4,271,497.

Figure 8:
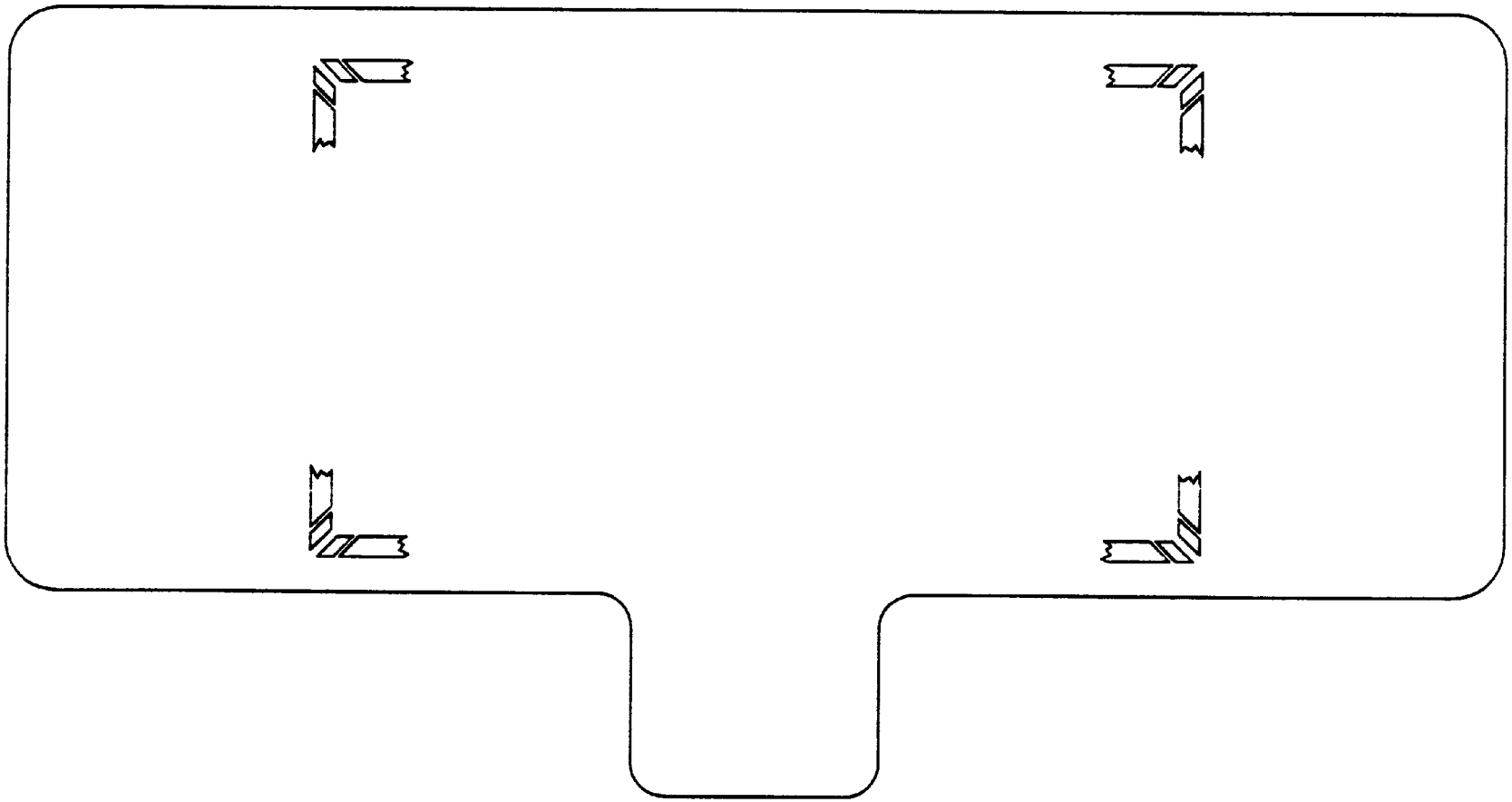
FIG. 8 is a view of the corners included within the dashed line circles of FIG. 1, again on a magnified scale, as in FIG. 2, showing an alternative embodiment of the invention.
Figure 9:
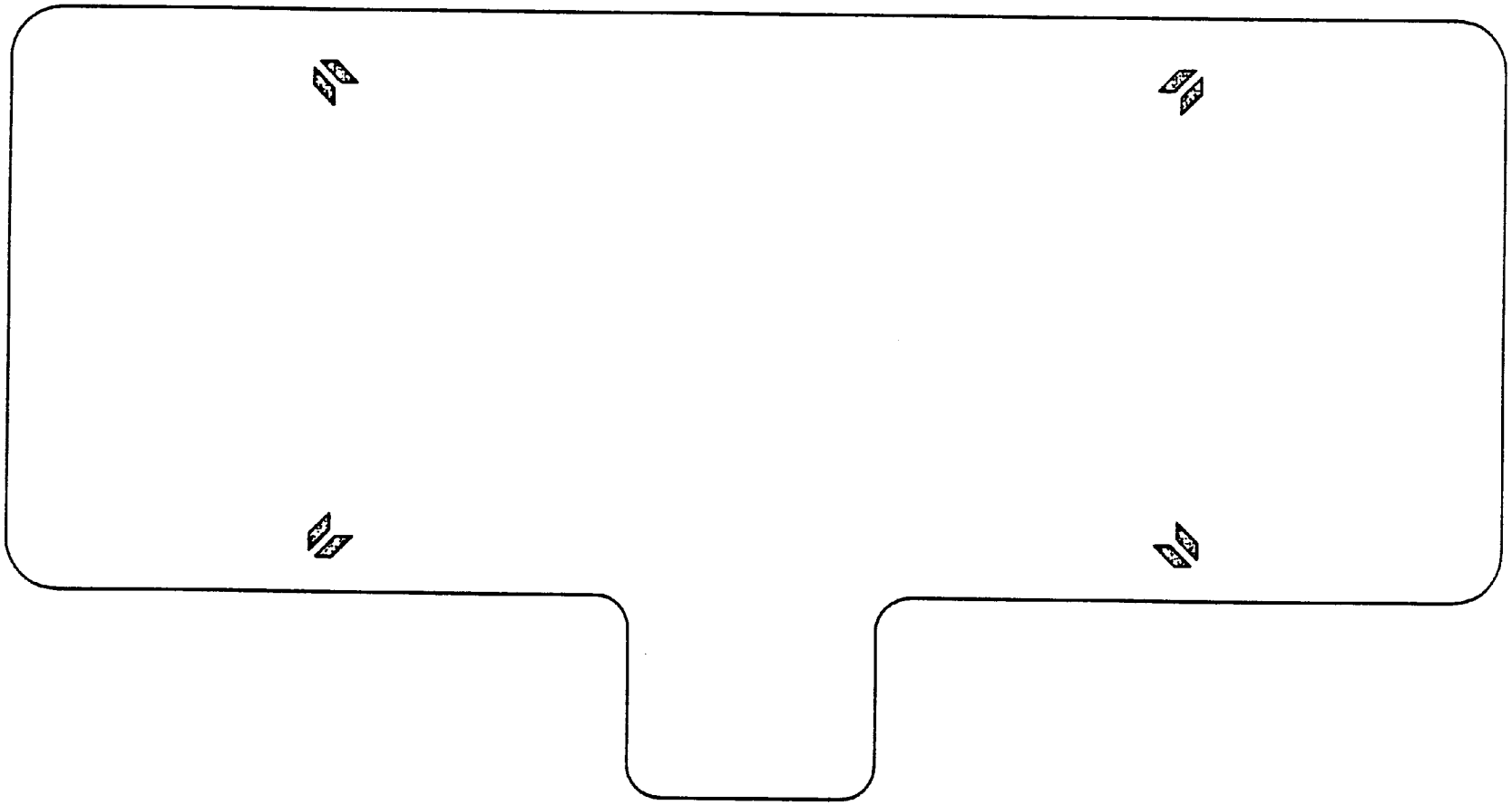
FIG. 9 is a view similar to FIG. 3 showing the markers formed by the alternative embodiment of FIG. 8, on the same reduced scale of FIG. 1.

FIGS. 8 and 9 portray an alternative embodiment of this invention. In particular, FIG. 8 shows on a magnified scale, the even more inwardly located inboard corners of the digital minute elements 14, 18 which are enclosed within the dashed line circles of FIG. 1. These corners are also severed and separated in the manner described for FIG. 2. However, whereas the severed corners of FIG. 2 result in the inclined double dash markers of FIG. 3 having sequences of alternate negative (slanting down from left to right) and positive (slanting up from left to right) slopes during the respective four quarter hours, the opposite sequence of positive-negative-positive-negative slopes are formed in FIGS. 8 and 9 due to the correspondingly opposite orientations of the corners respectively circled in the solid and dashed lines of FIG. 1. The end result is that the alternative markers of FIG. 9 create a spot lighting or highlighting effect to the central area of the display, in contrast to the surrounding or rotationally sweeping sense of motion generated by the markers of FIG. 3 around the center of the display.

Figure 10:
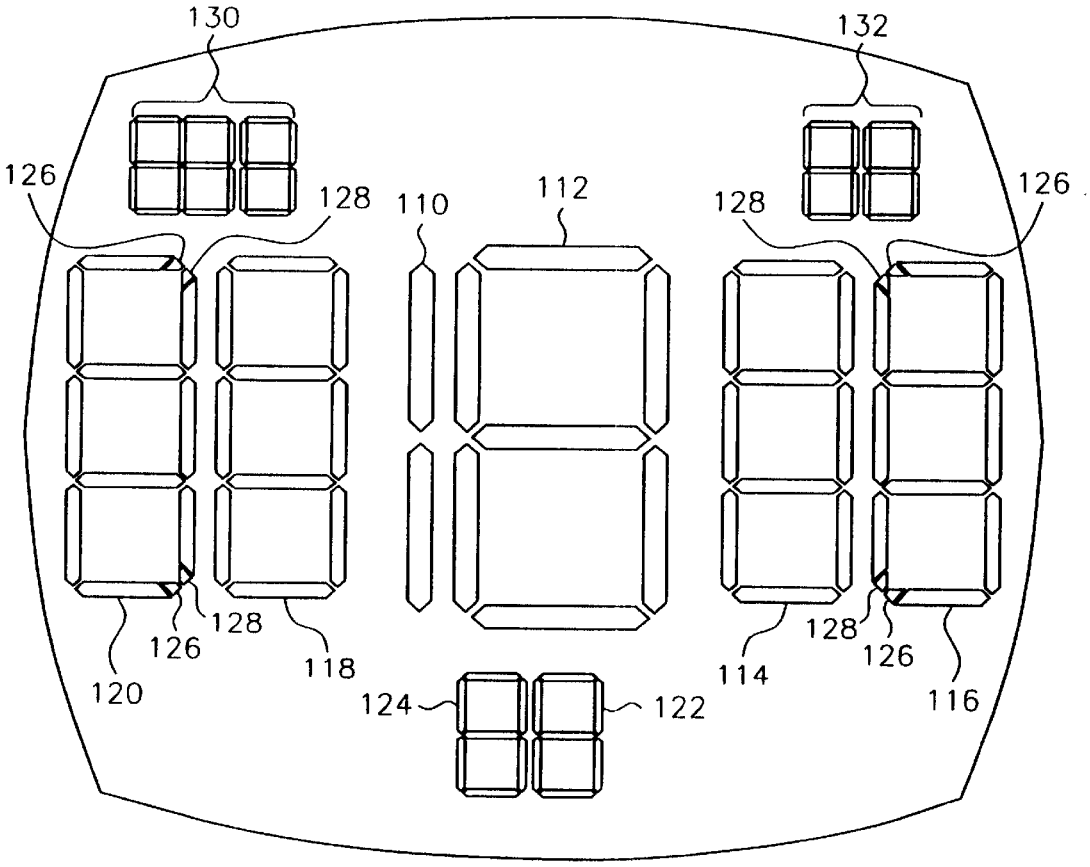
FIG. 10 is a view similar to FIG. 1 showing another embodiment of the invention.
Figure 11D:
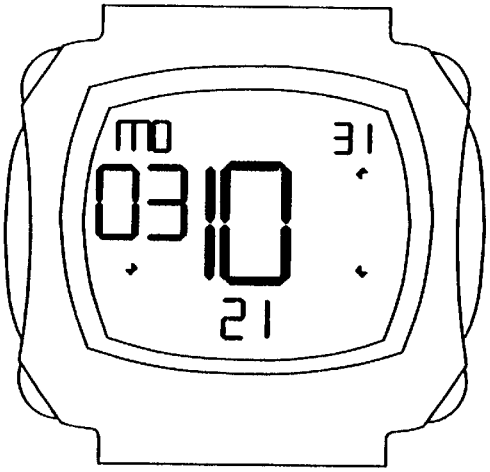
FIGS. 11A–11D are views of representative quarter hour time displays presented to the viewer with the embodiment of FIG. 10.
Figure 11A:
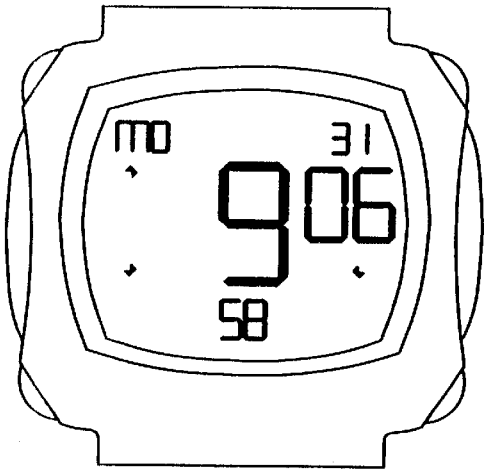
Figure 11C:
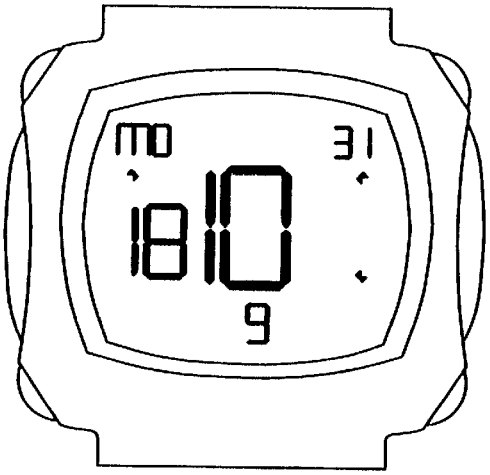
Figure 11B:
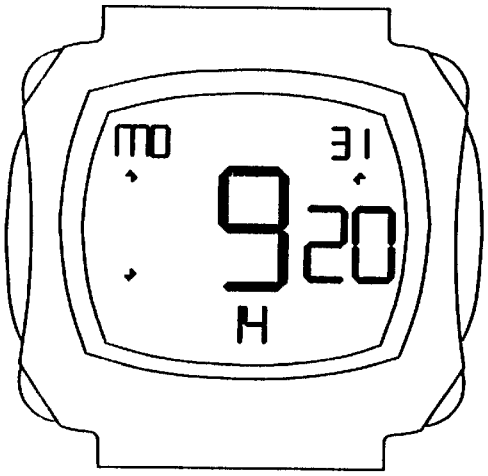
Figure 12D:
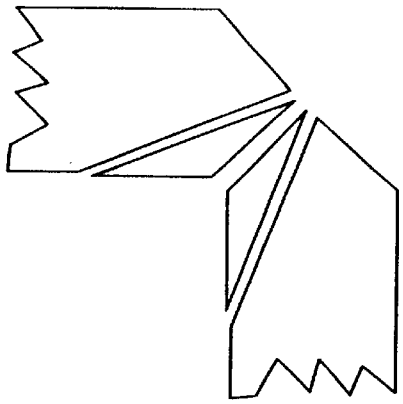
FIGS. 12A–12D are views of another embodiment of the invention.
Figure 12A:
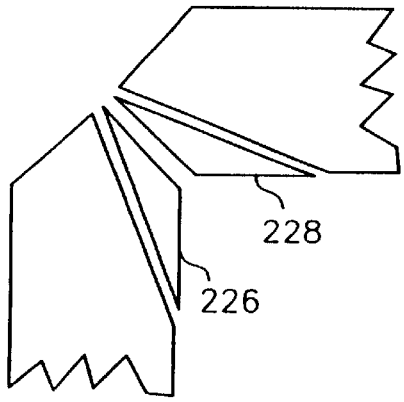
Figure 12C:
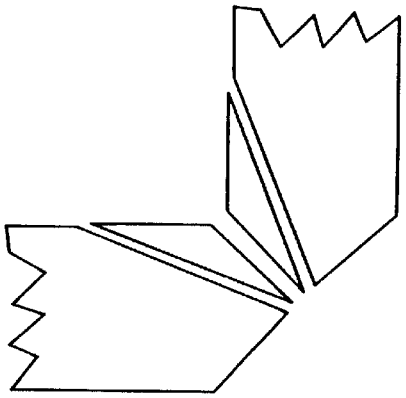
Figure 12B:
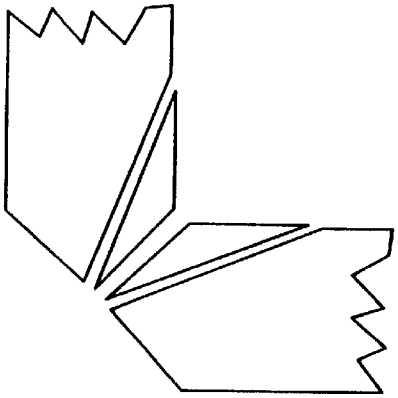

Another preferred embodiment of digital display elements for practicing this invention is illustrated in FIG. 10 which includes all of the display elements of FIG. 1 in a modified form. Therefore, corresponding elements in FIG. 10 have been given the same reference numerals as in FIG. 1, preceded with a 100 prefix, e.g., element 10 in FIG. 1 is referenced as 110 in FIG. 10, and so forth. In addition, FIG. 10 includes display elements 130 which are useful for displaying abbreviated first-two-letter names of the days of each week. The additional elements 132 are also included for displaying the dates of the days of each month.

A principal difference between FIGS. 1 and 10 is that all of the display elements of the latter have sharp pointed ends, shaped substantially as symmetrical arrowheads or spear points, with enclosed angles of substantially 90°. These pointed ends are spaced and nested together as closely as possible, such that the spaces between them are aligned preferably at substantially 45° of inclination. As a result, all of the time values displayed by the elements 110–124 of FIG. 10 gain enhanced symmetry of sizes and shapes. In addition, the severed inboard corners of elements 116 and 120 in FIG. 10 (markers 126, 128), analogous to those shown within solid circles in FIG. 1, have a different shape than the corresponding corner elements 26, 28 in FIG. 2. The latter comprise four pairs of markers, each element of which is shaped substantially as a parallelogram with two pairs of parallel opposite sides. In FIG. 10, the analogous markers comprise element pairs each of which is trapezoidal in shape with only one pair of parallel opposite sides.

As a result, each of the FIG. 10 markers extends toward the quarter hour space it marks with diverging slanted edges at its near ends and with squared off straight edges at its opposite far ends. This creates a distinctive shape that expands and enlarges toward the empty quarter hour space and at the same time closes off the space with an opposite straight-edged boundary that marks the uppermost or lowermost extent of the space. This contrasts from the sharp points that define the near and far ends of the markers of FIG. 1 due to the fact that they are shaped as pairs of parallelograms that lack squared off, right angled corners as in FIG. 10.

FIGS. 11A–11D illustrate representative time/day/date displays obtained during respective first through fourth quarter hours by activation of the corresponding elements of FIG. 10. The differences in the symmetries of element sizes and shapes, as well as the different shapes of these markers, can be seen by comparison with the representative displays of FIGS. 4–7 derived from FIG. 1.

FIGS. 12A–12D illustrate a variation of markers derived from FIG. 10 which provides a more stylized and streamlined sequence of quarter hour markers 226, 228 compared to FIGS. 11A–11D. In FIGS. 12A–12D only the analogous inboard severed corners of the FIG. 10 minute elements that generate such markers are shown on a somewhat enlarged scale to facilitate comprehension. As can be seen, the second sets of severance lines in each of these pairs extend from the sharp points at the ends of the elements, at an acute angle across each element until the inner horizontal and vertical edges thereof are reached and severed. Therefore, the resulting triangular sections of these ends of the minute elements can be separately activated to generate quarter hour markers having the shapes shown in FIGS. 13A–13D. Like the markers in FIGS. 11A–11D, the markers in FIGS. 13A–13D point toward the minute positions being marked with diverging inner edges at their relatively near ends, but extend back to sharp points at their opposite relatively far ends. Such shapes more closely resemble the shapes of the digital minutes displayed during the respective quarter hours and therefore may be more preferred as reminiscent markers which inform the viewer that such marked positions will be used to tell time at the appropriate intervals of each hour.

The marker shapes illustrated in FIGS. 13A–13D are based on second severance lines oriented at angles and having lengths which create markers shaped substantially as isosceles triangles. However, other angles, lengths and orientations of such severance lines can obviously be adopted to create generally analogous but specifically different shapes and sizes of such markers.

Figure 13D:
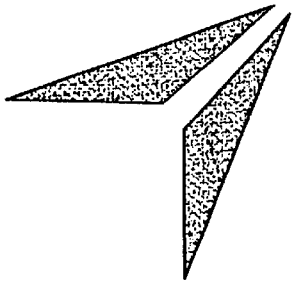
FIGS. 13A–13D are views of quarter hour markers that are presented to the viewer with the embodiment of FIGS. 12A–12D.
Figure 13A:
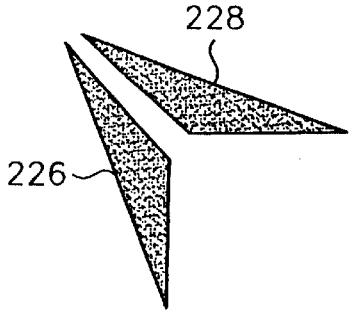
Figure 13C:
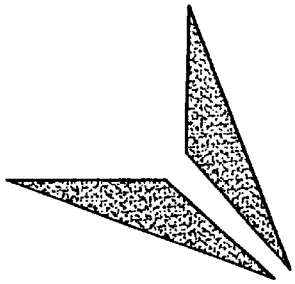
Figure 13B:
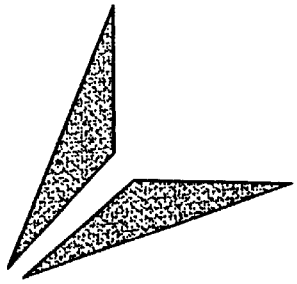

Moreover, the marker shapes in FIGS. 13A–13D, having an overall appearance of arrowheads, create symbolic suggestions that enhance the graphic effects produced by such markers. In particular, during the first half hour, the midpoint of such period is in between the first and second quarter hours. FIGS. 13A and 13B correspondingly display divergence and convergence of the backs of the arrowheads, angled to open toward and close away from quarter hour positions, thus symbolizing expansion and contraction of these respective quarter hour intervals. Also, the second marker, FIG. 13B, points toward the direction that the remaining third and fourth quarter hours will be displayed.

Similarly, the markers of FIGS. 13C and 13D provide analogous advantages. The backs of these markers also diverge and converge in angled positions toward and away from both quarter hour positions to symbolize expansion and contraction of these time periods. Also, the FIG. 13D marker points toward the top of the fourth, i.e. last, quarter hour position, which symbolizes the approaching end of the present hour and the simultaneous commencement of the displayed next hour.

Accordingly, the markers of FIGS. 13A–13D, when incorporated in quadribalanced time displays, e.g. as illustrated representatively in FIGS. 11A–11D, provide an optimum time display protocol in which the progress of each quarter hour is visually differentiated from the others and the exact time within each is instantly digitally defined, with complete visual and numerical balance between both the halves and the quarters of every hour.

The above-described alternative embodiments demonstrate that many other choices can be made to form design markers of various shapes that may be more or less appealing to the preferences of different viewers. Use of conventional dot matrix display elements or other high resolution elements in embodying the teachings of this invention will enable the markers to be configured in the shapes of one or more dots, dashes, asterisks, stars, arrowheads, ramps, triangles, squares, rectangles or other symbols that will perform the functions described for the exemplary embodiments discussed above.

It will be appreciated that, preferably, the spaces between the elements 26, 28, 126 and 128, including the corresponding spaces in FIGS. 12A–12D, and their respective horizontal and vertical elements, in all cases, should be as narrow as possible to enable separate electronic energizing of these elements while maintaining their closest feasible visual continuity.

Also, while in the preferred embodiment all four quarter hour areas are simultaneously activated with the current time and the three non-time-telling markers throughout the entire hour, other sequences can be used. For example, the quarter hour showing the current time can be accompanied by one marker in either the next or previous quarter hour space, or by a pair of markers in both the next and previous quarter hour spaces.

Figure 14:
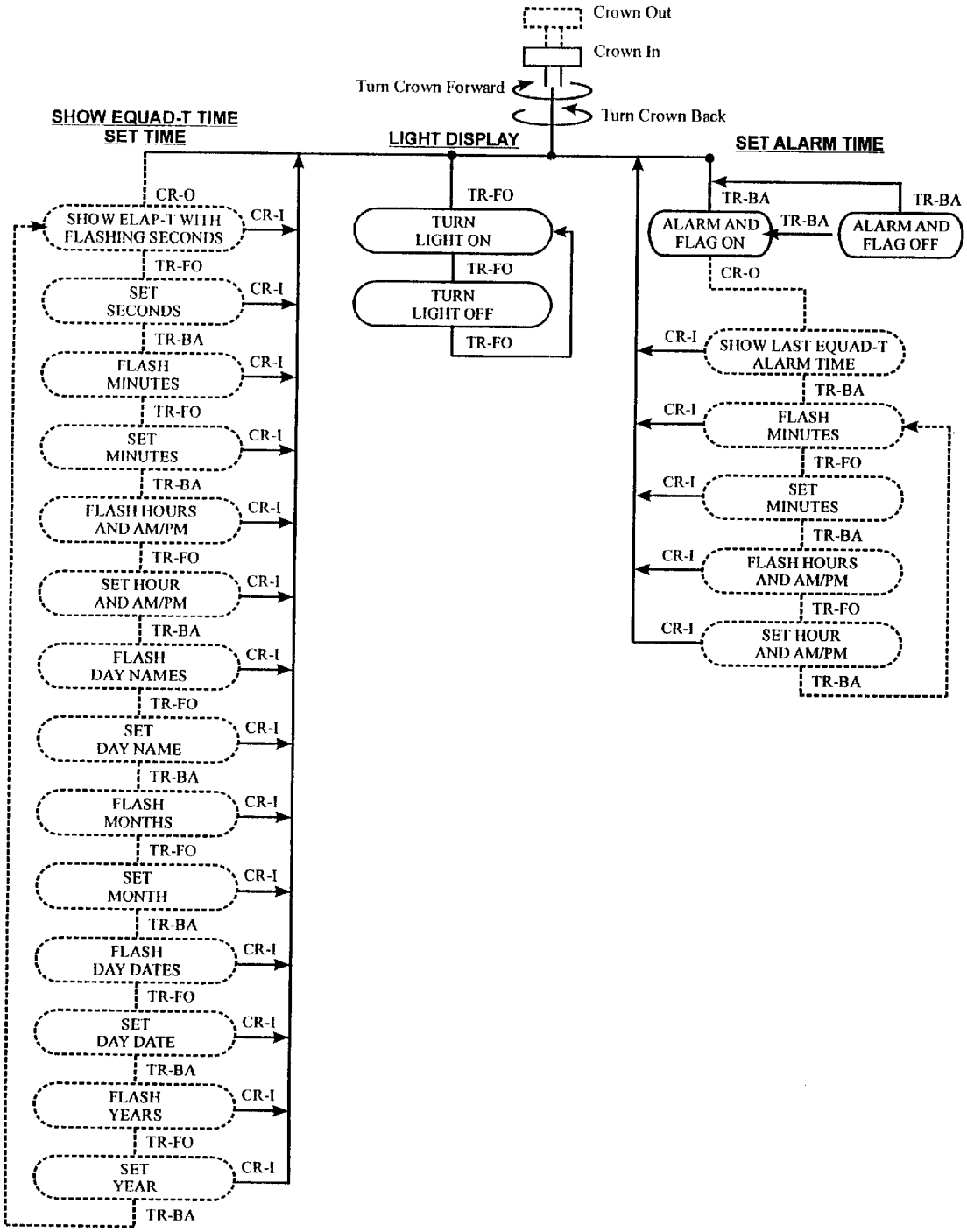
FIG. 14 is a chart which illustrates a preferred embodiment of a single displaceable crown adapted for controlling all of the setting functions of a timepiece that is programmed to display enhanced quadribalanced digital time pursuant to this invention, coupled with a programmable alarm.

Referring now to FIG. 14, illustrated there is a chart which depicts the functional attributes of a single displaceable crown control, of the type described, for example, in U.S. Pat. No. 4,720,823, the disclosure of which is incorporated herein by reference. This crown control is adapted to operate, in a preferred manner, all of the setting functions of an enhanced quadribalanced timepiece that is also provided with a programmable alarm.

At the top, the crown is depicted in solid and dashed outline which symbolizes that it may be displaced between alternate positions that are crown in (solid outline) and crown out (dashed outline) relative to a wristwatch case, for example. These positions are abbreviated in the remaining lower portion of the chart as "CR-I" and "CR-O", respectively.

This displaceable crown is also illustrated at the top of the chart as being rotatable in a forward direction labeled "Turn Crown Forward" (clockwise arrow) and in an opposite backward direction labeled "Turn Crown Back" (counterclockwise arrow), preferably for approximately a quarter turn of one full revolution in either direction, as taught in U.S. Pat. No. 4,720,823. These turning motions are abbreviated in the remaining lower portion of the chart as "TR-FO" and "TR-BA", respectively.

The displaceable crown is connected vertically to a lower horizontal line in FIG. 14 that has headings comprising "Show Equad-T Time, Set Time", "Light Display" and "Set Alarm Time". Two of the functional sequences below the headings, "Light Display" and "Set Alarm Time", can be entered without performing a CR-O operation, signifying that these sequences are available with the crown in the CR-I position. Thus, under the "Light Display" heading with the crown in CR-I, repeated TR-FO turns are programmed to alternately turn on and off a light, that correspondingly does and does not illuminate the display to enable viewing the displayed time in the dark. Accordingly, alternating TR-FO motions of the crown in the CR-I position are dedicated to performing this sole function of lighting and not lighting the display.

Next, under the "Set Alarm Time" heading and with the crown still in the CR-I position, repeated TR-BA turns are programmed to turn on and off, and thereby activate and deactivate, both an alarm symbol in the display and an audible alarm which will be heard at a pre-selected time. Thus, alternating TR-BA turns of the crown in CR-I position are dedicated to the sole function of activating and deactivating the audible alarm and its symbol in the display.

Referring next to the heading "Show Equad-Time, Set Time", "Equad-T" is an abbreviation for the enhanced quadribalanced time displays of this invention, as previously described above. Thus, with the crown in the CR-I position, this is the type of time display that is provided to the viewer. Alternatively, when the crown is displaced to its CR-O position, as indicated in the first step below the heading,[1] the display is programmed to automatically switch to a display of conventional digital time (abbreviated "Elap-T") comprising the centrally located hour flanked on the right by elapsed minutes in the upper right position, with flashing elapsed seconds below the hour. These time values are maintained throughout the entire course of an hour while the crown is in the CR-O position to distinguish the time setting mode from the enhanced quadribalanced real time mode which is restored when the crown is returned back into the CR-I position, after setting or resetting of the time has been completed, pursuant to the teachings of U.S. Pat. No. 5,182,733, the disclosure of which is incorporated herein by reference. Preferably, this contrast is increased by eliminating the markers ordinarily included in the second, third and fourth quarter hour minute positions of enhanced quadribalanced time, thereby reinforcing the viewer's ability to recognize and comprehend that the display is in the time setting mode initiated by displacing the crown to its CR-O position.

[1] All CR-O steps and functions are indicated by dashed lines in FIG. 14.

Continuing with the time setting functions depicted in the left column of the FIG. 14 chart, it will be understood that each successive function is selected and flashed by a TR-BA turn of the crown, and thereafter each such function is set by a TR-FO turn of the crown until the correct value has been reached in the display. In addition, the display can be returned to real time at any chosen interval of the time setting sequence by returning the crown back to its CR-I position, with automatic restoration of Equad-T time, as signified by the arrows labeled CR-I on the right of each function, again in a manner similar to the teachings of U.S. Pat. No. 5,182,733. Thus, during the setting process, all TR-BA turns are dedicated to flashing selected functions for setting, and all TR-FO turns are dedicated to setting the flashing function.

Referring lastly to the heading Set Alarm Time, as previously noted while the crown is in the CR-I position, repeated TR-BA turns of the crown will activate and deactivate the alarm symbol and function. Therefore, as the chart shows, in order to prepare to select and set a chosen alarm time, the activated alarm symbol/function is first established in the display by a TR-BA turn of the crown. Next the crown is displaced to its CR-O position which is programmed to restore in the display the last previously set alarm time in Equad-T time, meaning the corresponding enhanced quadribalanced time, including preferably the corresponding markers in the three quarter positions not occupied by the minutes of the alarm time shown in the relevant fourth quarter position, and preferably without any display of seconds which would be superfluous for setting any alarm time. Moreover, the hour and minutes of the last previously set alarm time are preferably not initially flashed, since there is no need to synchronize such time values with an announced accurate real time source. Thus, by enabling the setting of alarm times in terms of such enhanced quadribalanced displays, the viewer will be provided with an immediate contrast from the conventional Elap-T time that is used for the setting or resetting of the display to real time, as previously described.

The selection and setting of an alarm time are set forth in the remaining sequences depicted in the chart below the Set Alarm Time heading. Again, all TR-BA turns of the crown select and flash a function for setting, and all TR-FO turns set the selected function. At any chosen interval, the display can be returned to Equad-T time by displacing the crown to its CR-I position. Preferably, the alarm symbol is kept activated in the display whenever there is a return to real time from an alarm setting operation to assure the viewer that the alarm will sound at that set time. Thereafter, a TR-BA turn will be programmed to turn off both the audible alarm and its symbol, until the same alarm time is reactivated by another TR-BA turn to restore the alarm and its symbol in the display, or until a new alarm time is chosen and set by the above-described procedure.

The preferred embodiment of a displaceable crown control illustrated in FIG. 14 and described hereinabove provides substantial advantages due to the singularities of logic and procedure embodied in its operation. Notably, with the crown in the CR-I position, all repeated forward turns of it will light and extinguish the lit display, whereas all repeated backward turns will activate and deactivate the alarm and its symbol. These singularities are easily remembered and distinguished from each other.

All setting of the display is achieved by displacing the crown to it CR-O position, another singularity that is easily remembered (and also reminiscent of how conventional dial watches are customarily set). If a CR-O displacement is performed without activation of an alarm symbol in the display, the display will enter into a setting mode for real time in terms of a conventional digital display. Conversely, if CR-O is preceded by an activated alarm symbol, the display will enter into a contrasting enhanced quadribalanced setting mode, again providing easily remembered singularities and distinctions between these two types of setting functions. Finally, during either type of setting, each function is selected and flashed for setting by TR-BA turns, and such respective selected functions are set by TR-FO turns. Such opposite motions are easily remembered and distinguished for the distinct operations that each performs.

The use of smaller sized digital zeros with representative digital unit minutes is shown in FIGS. 4 and 7 of this application. Further details on the implementation and advantages of such displays during the first and last nine minutes of each hour are described in U.S. Pat. No. 5,805,534, the disclosure of which is incorporated herein by reference. Also, the uppermost six horizontal elements of the 10-segmented display elements 18, 20 in FIG. 1 of this application can be flashed during the last minute of each hour in the manner described in U.S. Pat. No. 5,757,730, the disclosure of which is also incorporated herein by reference. Furthermore, during the interval from the thirtieth to thirty-first minutes, preferably an initial digital minute of value 30 together with digital seconds of values 0 to 30 are displayed during the first half of the interval, followed by a digital minute of value 29 together with digital seconds of values 29 to 0 during the second half of the interval, as taught in U.S. Pat. No. 4,627,737, the disclosure of which is incorporated by reference.

In conclusion, the present invention has been described above in terms of its general principles and specific embodiments. Many variations of such disclosure will be obvious to those skilled in the art. Accordingly, it should be understood that the ensuing claims are intended to cover all changes and modifications of the specific illustrative embodiments which fall within the literal scope of the claims and all equivalents thereof.

The following is claimed:

1. A crown control system for facilitating the operation of a timepiece embodying enhanced quadribalanced time displays, having at least second, third and fourth quarter positions and having markers in at least said second, third and fourth quarter positions, comprising:

(a) a single crown displaceable between crown in and crown out positions relative to the timepiece and rotatable in clockwise and counterclockwise directions in either of said positions;

(1) said crown when in the crown in position:

(i) when repeatedly rotated in one of said directions being operable to turn on and off a light for illuminating/not illuminating the display; and (ii) when repeatedly rotated in the other of said directions being operable to activate and deactivate an alarm and an alarm symbol in the display to become audible at a preset time; and (2) said crown when in the crown out position:

(iii) without prior activation of the alarm and the alarm symbol in the display, being operable to convert the display to conventional digital elapsed time, without the markers of enhanced quadribalanced time in the second, third and fourth quarter positions, thereby enabling the display to be set to real time by repeatedly rotating the crown in one of said directions to select and flash a time function and by repeatedly rotating the crown in the other of said directions to set the respective flashing functions; and (iv) with prior activation of the alarm and the alarm symbol, being operable to display enhanced quadribalanced time, without a display of seconds or flashing time values, thereby enabling the display to be set to a selected alarm time by repeatedly rotating the crown in one of said directions to select and flash a time function and by repeatedly rotating the crown in the other of said directions to set the respective flashing functions; and said crown when displaced back to the crown in position, after a setting procedure pursuant to 1(a)(2)(iii) above, being operable to automatically convert the display to the equivalent enhanced quadribalanced time; and said crown when displaced back to the crown in position, after an alarm setting procedure pursuant to 1(a)(2)(iv) above, being operable to retain the preset audible alarm and alarm symbol in the display.

2. A crown control system according to claim 1 wherein all rotations of the crown in said one of said directions is clockwise and all rotations of the crown in said other of said directions is counterclockwise.

3. A crown control system according to claim 1 in which all crown rotations are approximately one quarter of a full revolution.

4. A crown control system according to claim 2 in which all crown rotations are approximately one quarter of a full revolution.

* * * * *

UNITED STATES PATENT AND TRADEMARK OFFICE

CERTIFICATE OF CORRECTION

PATENT NO. : 6,386,754 B2
DATED : May 14, 2002
INVENTOR(S) : Berj A. Terzian

It is certified that error appears in the above-identified patent and that said Letters Patent is hereby corrected as shown below:

Title page,
Item [57], ABSTRACT,
Line 16, after the word "methods" insert -- and having application to other digital timekeeping displays, methods or systems as well --.

Figure 2:
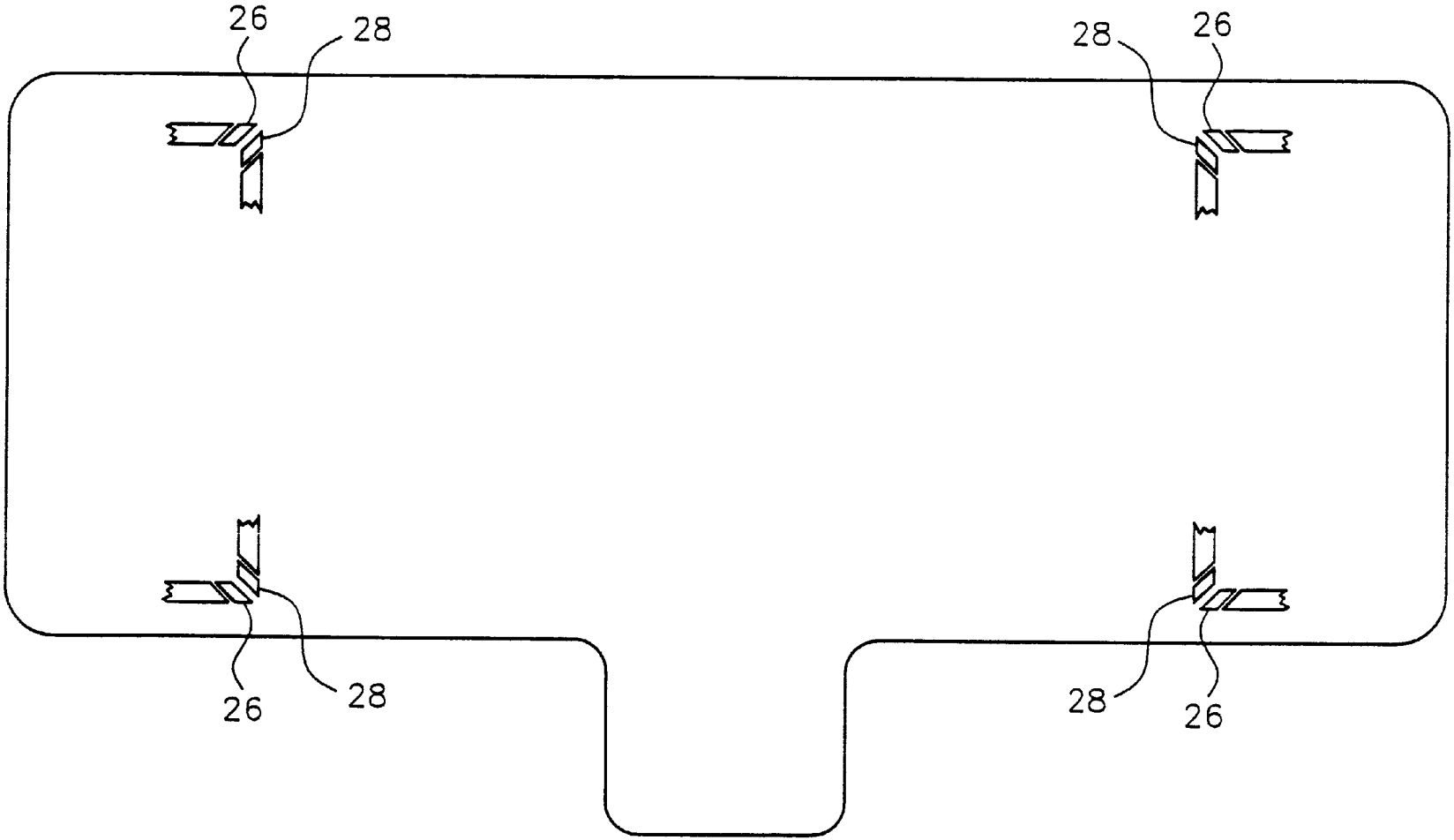
FIG. 2 is a view of the corners included within the solid line circles of FIG. 2 on a magnified scale to facilitate visualization and comprehension.

Column 2,
Lines 31-32, delete "FIG. 2 on a magnified scale to facilitate visualization and comprehension" and substitute therefor -- FIG. 1 in detail --.
Lines 33-34, delete "same circled corners reduced back to the scale" and substitute therefor -- corners included within the solid line circles --.
Line 41, delete ", again on a magnified scale," and substitute therefor -- in detail --.
Lines 44-45, delete ", on the same reduced scale of FIG. 1".

Column 3,
Line 33, delete "on a magnified scale" and substitute therefor -- in detail --.
Line 40, change "FIG. 1" to -- FIG. 2 --.

Column 4,
Line 46, delete "on a magnified scale,".

Column 9, line 45, through column 10, line 49,
Cancel all claims ("1. A crown..." through "revolution.") and substitute therefor the following claims:

1. A crown control system for facilitating the operation of a timepiece that displays digital time, consisting essentially of:

a single crown displaceable between crown in and crown out positions relative to the timepiece and rotatable in clockwise and counterclockwise directions in either of said positions;

(a) said crown when in the crown in position:

(i) when repeatedly rotated in one of said directions being dedicated solely to turn on and off a light for illuminating/not illuminating the display; and (ii) when repeatedly rotated in the other of said directions being dedicated solely to activate and deactivate an alarm symbol in the display and an alarm to become audible at a preset time; and (b) said crown when in the crown out position:

(i) without prior activation of the alarm and the alarm symbol in the display, being dedicated solely to enable the display to be set to real time by repeatedly rotating the crown in one of said directions to select and flash a time function, and by repeatedly rotating the crown in the other of said directions to set the respective flashing functions; and

UNITED STATES PATENT AND TRADEMARK OFFICE

CERTIFICATE OF CORRECTION

PATENT NO. : 6,386,754 B2
DATED : May 14, 2002
INVENTOR(S) : Berj A. Terzian

It is certified that error appears in the above-identified patent and that said Letters Patent is hereby corrected as shown below:

Column 9, line 45, through column 10, line 49, cont'd, (ii) with prior activation of the alarm and the alarm symbol, being dedicated solely to enable the display to be set to a selected alarm time by repeatedly rotating the crown in one of said directions to select and flash a time function, and by repeatedly rotating the crown in the other of said directions to set the respective flashing functions; and said crown upon displacement back to the crown in position, after a setting procedure pursuant to (b)(i) above, being operable to automatically return the display to the set real time; and said crown upon displacement back to the crown in position, after an alarm setting procedure pursuant to (b)(ii) above, being operable to retain the preset audible alarm and alarm symbol in the display.

2. A system according to Claim 1 wherein with the crown in the (b)(i) position, repeated rotations of it in the counterclockwise direction flash time functions for setting, in the sequence of seconds, minutes, hours, AM/PM, day name, month date, day date and year date.

3. A system according to Claim 2 wherein upon the next counterclockwise rotation of the crown, the specified sequence begins to repeat itself for as many repetitions as a user may desire by continuing to perform such counterclockwise rotations.

4. A crown control system for facilitating the operation of a timepiece that displays digital time consisting of:

a single crown displaceable between crown in and crown out positions relative to the timepiece and rotatable in clockwise and counterclockwise directions in either of said positions;

(a) said crown when in the crown in position:
  (i) when repeatedly rotated in the clockwise direction being dedicated solely to turn on and off a light for illuminating/not illuminating the display; and
  (ii) when repeatedly rotated in the counterclockwise direction being dedicated solely to activate and deactivate an alarm symbol in the display and an alarm to become audible at a preset time; and (b) said crown when in the crown out position:
  (i) without prior activation of the alarm and the alarm symbol in the display, being dedicated solely to enable the display to be set to real time by repeatedly rotating the crown in the counterclockwise direction to select and flash a time function, and by repeatedly rotating the crown in the clockwise direction to set the respective flashing functions; and
  (ii) with prior activation of the alarm and the alarm symbol, being dedicated solely to enable the display to be set to a selected alarm time by repeatedly rotating the crown in the counterclockwise direction to select and flash a time function, and by repeatedly rotating the crown in the clockwise direction to set the respective flashing functions; and said crown upon displacement back to the crown in position, after a setting procedure pursuant to (b)(i) above, being operable to automatically return the display to the set real time; and

UNITED STATES PATENT AND TRADEMARK OFFICE

CERTIFICATE OF CORRECTION

PATENT NO. : 6,386,754 B2
DATED : May 14, 2002
INVENTOR(S) : Berj A. Terzian

It is certified that error appears in the above-identified patent and that said Letters Patent is hereby corrected as shown below:

Column 9, line 45, through column 10, line 49, cont'd, said crown upon displacement back to the crown in position, after an alarm setting procedure pursuant to (b)(ii) above, being operable to retain the preset audible alarm and alarm symbol in the display.

5. A system according to Claim 4 wherein with the crown in the (b)(i) position, repeated counterclockwise rotations of it flash time functions for setting, in the sequence of seconds, minutes, hours, AM/PM, day name, month date, day date and year date.

6. A system according to Claim 5 wherein upon the next counterclockwise rotation of the crown, the specified sequence begins to repeat itself for as many repetitions as a user may desire by continuing to perform such counterclockwise rotations.

Signed and Sealed this

Thirteenth Day of January, 2004

JON W. DUDAS
*Acting Director of the United States Patent and Trademark Office*